US006547016B2

(12) United States Patent
Wassell

(10) Patent No.: US 6,547,016 B2
(45) Date of Patent: Apr. 15, 2003

(54) APPARATUS FOR MEASURING WEIGHT AND TORQUE ON DRILL BIT OPERATING IN A WELL

(75) Inventor: Mark Ellsworth Wassell, Kingswood, TX (US)

(73) Assignee: APS Technology, Inc., Cromwell, CT (US)

( * ) Notice: Subject to any disclaimer, the term of this patent is extended or adjusted under 35 U.S.C. 154(b) by 0 days.

(21) Appl. No.: 09/734,983

(22) Filed: Dec. 12, 2000

(65) Prior Publication Data

US 2002/0070050 A1 Jun. 13, 2002

(51) Int. Cl.[7] ..... E21B 47/00

(52) U.S. Cl. ..... 175/45; 166/113; 166/250.01; 73/152.46; 73/152.49

(58) Field of Search ..... 73/152.43, 152.46, 73/152.49; 166/250.01, 113; 175/40, 45

(56) References Cited

U.S. PATENT DOCUMENTS

| | | | | |
|---|---|---|---|---|
| 3,968,473 A | | 7/1976 | Patton et al. | 340/18 LD |
| 4,303,994 A | | 12/1981 | Tanguy | 367/35 |
| 4,324,297 A | | 4/1982 | Denison | 175/45 |
| 4,359,898 A | | 11/1982 | Tanguy et al. | 73/151 |
| 4,445,578 A | | 5/1984 | Millheim | 175/45 |
| 4,479,564 A | | 10/1984 | Tanguy | 181/105 |
| 4,662,458 A | | 5/1987 | Ho | 175/27 |
| 4,715,451 A | | 12/1987 | Bseisu et al. | 175/40 |
| 4,739,841 A | * | 4/1988 | Das | 175/45 |
| 4,760,735 A | * | 8/1988 | Sheppard et al. | 73/152.43 |
| 4,802,143 A | * | 1/1989 | Smith | 175/40 |
| 4,821,563 A | | 4/1989 | Maron | 73/151 |
| 4,958,517 A | | 9/1990 | Maron | 73/151 |
| 5,251,708 A | * | 10/1993 | Perry et al. | 175/41 |
| 5,386,724 A | | 2/1995 | Das et al. | 73/151 |
| 6,068,394 A | * | 5/2000 | Dublin | 175/39 |
| 6,216,533 B1 | * | 4/2001 | Woloson et al. | 166/250.01 |

* cited by examiner

*Primary Examiner*—David Bagnell
*Assistant Examiner*—Jennifer H Gay
(74) *Attorney, Agent, or Firm*—Woodcock Washburn LLP

(57) ABSTRACT

An apparatus for measuring the weight and torque on a drill bit operating down hole in a well. The apparatus comprises at least three pockets circumferentially spaced equidistantly around the drill collar of the drill string to which the drill bit is attached. Eight strain gages are equidistantly circumferentially spaced around each of the pockets so as to form first and second sets of strain gages. The strain gages in the first set are connected into one Wheatstone bridge while the gages in the second set are connected in a second bridge. Each of the strain gages that are oriented similarly within each of the pockets are connected in series within a single leg of a bridge so that the output voltage of the bridge is unaffected by bending in the drill string. The output of first bridge is used to determine the weight on the drill bit while the output of the second bridge is used to determine the torque on the drill bit.

19 Claims, 6 Drawing Sheets

FIG. 2
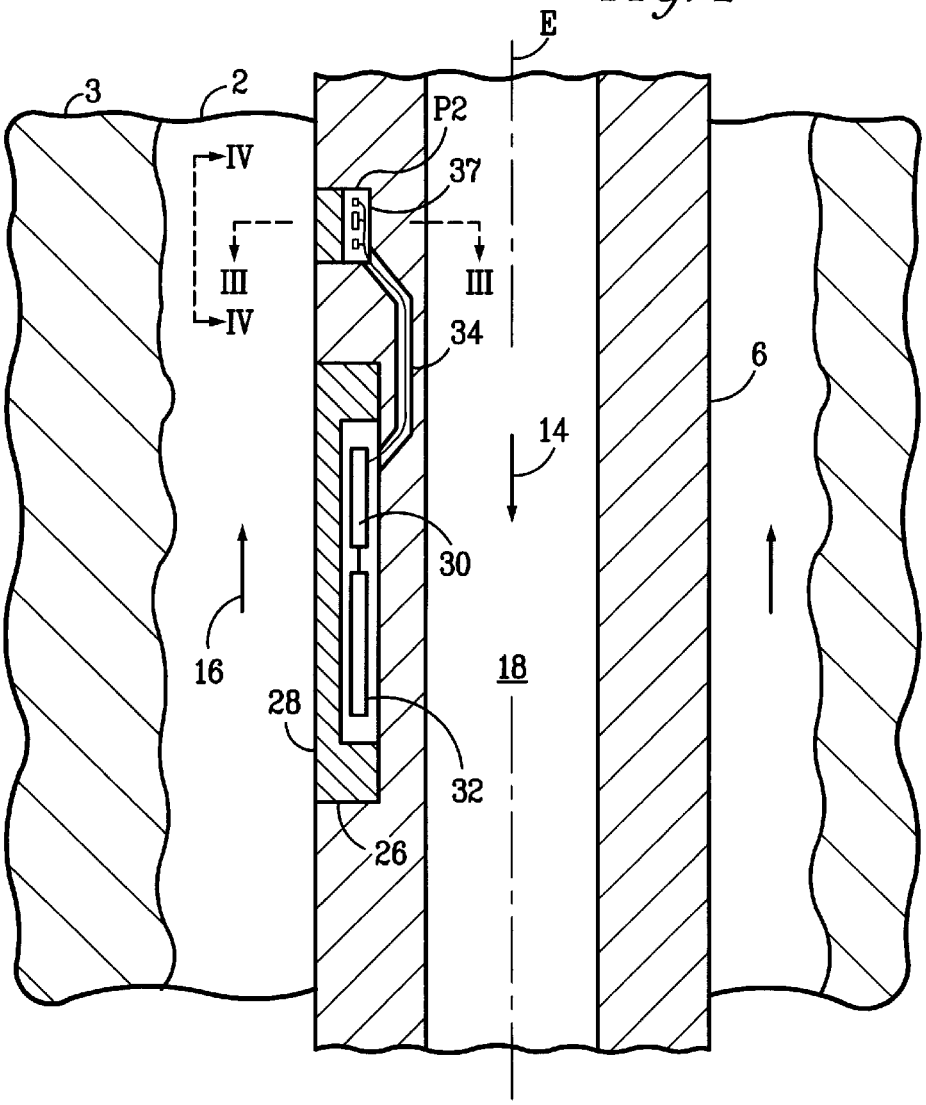
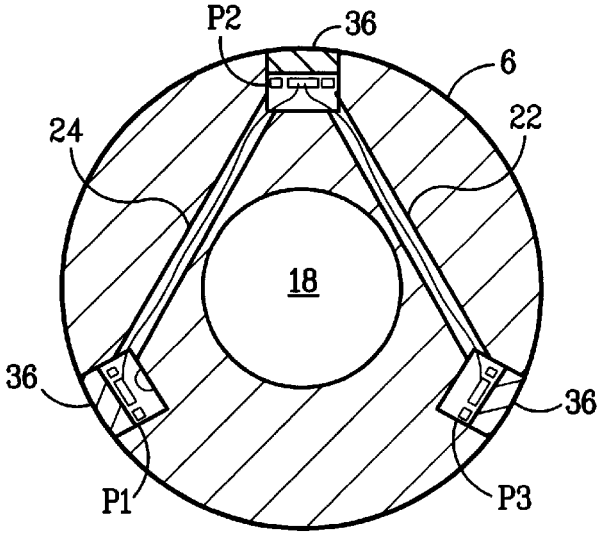
FIG. 3

APPARATUS FOR MEASURING WEIGHT AND TORQUE ON DRILL BIT OPERATING IN A WELL

FIELD OF THE INVENTION

The current invention is directed to an apparatus for measuring the weight and/or torque on a drill bit. More specifically, the current invention is directed to the measurement of the weight and torque on a drill bit operating down hole in a well, such as an oil well.

BACKGROUND OF THE INVENTION

In underground drilling, such as gas, oil or geothermal drilling, a bore is drilled through a formation deep in the earth. Such bores are formed by connecting a drill bit to sections of pipe, referred to as "drill pipe," so as to form an assembly commonly referred to as a "drill string" that is suspended from a rig at the surface and that extends down to the bottom of the bore. The drill bit is rotated so that it advances into the earth, thereby forming the bore. In rotary drilling, the drill bit is rotated by rotating the drill string at the surface. In directional drilling, the drill bit is rotated by a down hole mud motor coupled to the drill bit; the remainder of the drill string is not rotated during drilling. In a steerable drill string, the mud motor is bent at a slight angle to the centerline of the drill bit so as to create a side force that directs the path of the drill bit away from a straight line. In any event, in order to lubricate the drill bit and flush cuttings from its path, piston operated pumps on the surface pump a high pressure fluid, referred to as "drilling mud," through an internal passage in the drill string and out through the drill bit. The drilling mud then flows to the surface through the annular passage formed between the drill string and the surface of the bore.

Depending on the drilling operation, the pressure of the drilling mud flowing through the drill string will typically be between 1,000 and 25,000 psi. In addition, there is a large pressure drop at the drill bit so that the pressure of the drilling mud flowing outside the drill string is considerably less than that flowing inside the drill string. Thus, the components within the drill string are subject to large pressure forces. In addition, the components of the drill string are also subjected to wear and abrasion from drilling mud, as well as the vibration of the drill string.

Reaction forces applied to the drill bit by the formation exert a variety of forces on the drill bit, including compressive forces operating in the axial direction, side forces and torque. The compressive force, referred to as the "weight on bit," can be controlled by varying the degree of support provided by the rig. The torque exerted on the drill bit by resistance from the formation, referred to "torque on bit," can be controlled by varying the torque applied by the motor that rotates the drill bit or that rotates the drill string.

Information concerning the weight and torque on the drill bit can provide useful information for the drilling operator. For example, the weight on the drill bit affects not only the rate at which the drill bit advances into the formation but the rate at which the drill bit wears. In addition, weight on bit information can be used for directional control of the drill string. By applying more or less weight one can control the build rate of the drill string. The torque on bit provides information about whether the bit is advancing smoothly into the formation or bouncing into and out of contact with the formation.

In the past, the weight and torque on the drill bit has been measured by means of strain gages incorporated into the drill string. The output from these strain gages is digitized and then transmitted to the surface via mud pulse telemetry that is, by encoding the information into pressure pulses created in the drilling mud that propagate to the surface where they are sensed by a transducer and decoded.

Unfortunately, the strain sensed by such gages is effect by not only the weight and torque on the bit but by side forces imposed on the drill bit that impart a bending moment to the drill string. Consequently, conventional weight and torque on bit measurement systems suffered from inaccuracies.

Consequently, it would be desirable to provide an apparatus for measuring weight and/or torque on a drill bit that is relatively insensitive to changes in the bending moment applied to the drill string.

SUMMARY OF THE INVENTION

It is an object of the current invention to provide an apparatus for measuring the weight and/or torque on a drill bit that is insensitive to changes in the bending moment applied to the drill string. This and other objects is accomplished in an apparatus comprising (i) a drill bit, (ii) a drill string operatively coupled to the drill bit, the drill string having a section disposed proximate the drill bit, the section of the drill string defining a centerline thereof, (iii) at least first, second and third pockets formed in the section of the drill string, the pockets circumferentially spaced equidistantly around the section of the drill bit, each of the pockets forming at least first and second walls, (iv) a first set of strain sensors for each of the pockets, each of the first sets of strain sensors affixed to one of the walls of its respective pocket, each of the first sets of strain sensors comprising first, second, third and fourth strain sensors circumferentially spaced equidistantly around the one of the walls of its respective pocket, each of the first strain sensors in each of the first sets of strain sensors disposed opposite the third strain sensors in its respective set, each of the second strain sensors in each of the first sets of strain sensors disposed opposite the fourth strain sensor in its respective set, each of first and third strain sensors in each of the first sets of strain sensors disposed along a first line approximately parallel to the centerline of the section of the drill string, each of the second and fourth strain sensors in each of the first sets of strain sensors disposed along a second line approximately perpendicular to the centerline of the section of the drill string, (v) first circuitry connecting each of the strain sensors in the first set of strain sensors, the first circuitry forming a first bridge, the first bridge comprising first, second, third and fourth legs, a first input junction formed between the first and second legs, a second input junction formed between the third and fourth legs, a first output junction formed between the first and fourth legs, a second output junction formed between the second and third legs, each of the first strain sensors in each of the first sets of strain sensors connected in series along the first leg of the first bridge, each of the second strain sensors in each of the first sets of strain sensors connected in series along the second leg of the first bridge, each of the third strain sensors in each of the first sets of strain sensors connected in series along the third leg of the first bridge, and each of the fourth strain sensors in each of the first sets of strain sensors connected in series along the fourth leg of the first bridge, (vi) means for applying a voltage across the first and second input terminals of the first bridge, (vii) means for sensing a voltage across the first and second output terminals of the first bridge, (viii) means for determining the weight on the drill bit from the voltage sensed across the first and second output terminals of the first bridge, (ix) a second set of strain sensors for each of the pockets, each of the second sets of strain sensors affixed to one of the walls of its respective pocket, each of the second sets of strain sensors comprising fifth, sixth, seventh, and eight strain sensors circumferentially spaced equidistantly around the one of the walls of its respective pocket, each of the fifth strain sensors in each of the second sets of strain sensors disposed opposite the seventh strain sensors in its respective set, each of the sixth strain sensors in each of the sets of strain sensors disposed opposite the eighth strain sensor in its respective set, each of first and third strain sensors in each of the second sets of strain sensors disposed along a third line oriented approximately 45° to the first line, each of the second and fourth strain sensors in each of the sets of strain sensors disposed along a fourth line oriented approximately perpendicular to the third line, (x) second circuitry connecting each of the strain sensors, the circuitry forming a second bridge, the second bridge comprising first, second, third and fourth legs, a first input junction formed between the first and second legs, a second input junction formed between the third and fourth legs, a first output junction formed between the first and fourth legs, a second output junction formed between the second and third legs, each of the fifth strain sensors in each of the second sets of strain sensors connected in series along the first leg of the second bridge, each of the sixth strain sensors in each of the sets of strain sensors connected in series along the second leg of the second bridge, each of the seventh strain sensors in each of the sets of strain sensors connected in series along the third leg of the second bridge, and each of the eighth strain sensors in each of the sets of strain sensors connected in series along the fourth leg of the second bridge, (xi) means for applying a voltage across the first and second input terminals of the second bridge, (xii) means for sensing a voltage across the first and second output terminals of the second bridge, (xiii) means for determining the torque on the drill bit from the voltage sensed across the first and second output terminals of the second bridge.

BRIEF DESCRIPTION OF THE DRAWINGS

FIG. 2 is a longitudinal cross-section through the drill collar portion of the drill string shown in FIG. 1.

FIG. 3 is a transverse cross-section taken along line III—III in FIG. 2.

DESCRIPTION OF THE PREFERRED EMBODIMENT

Figure 1:
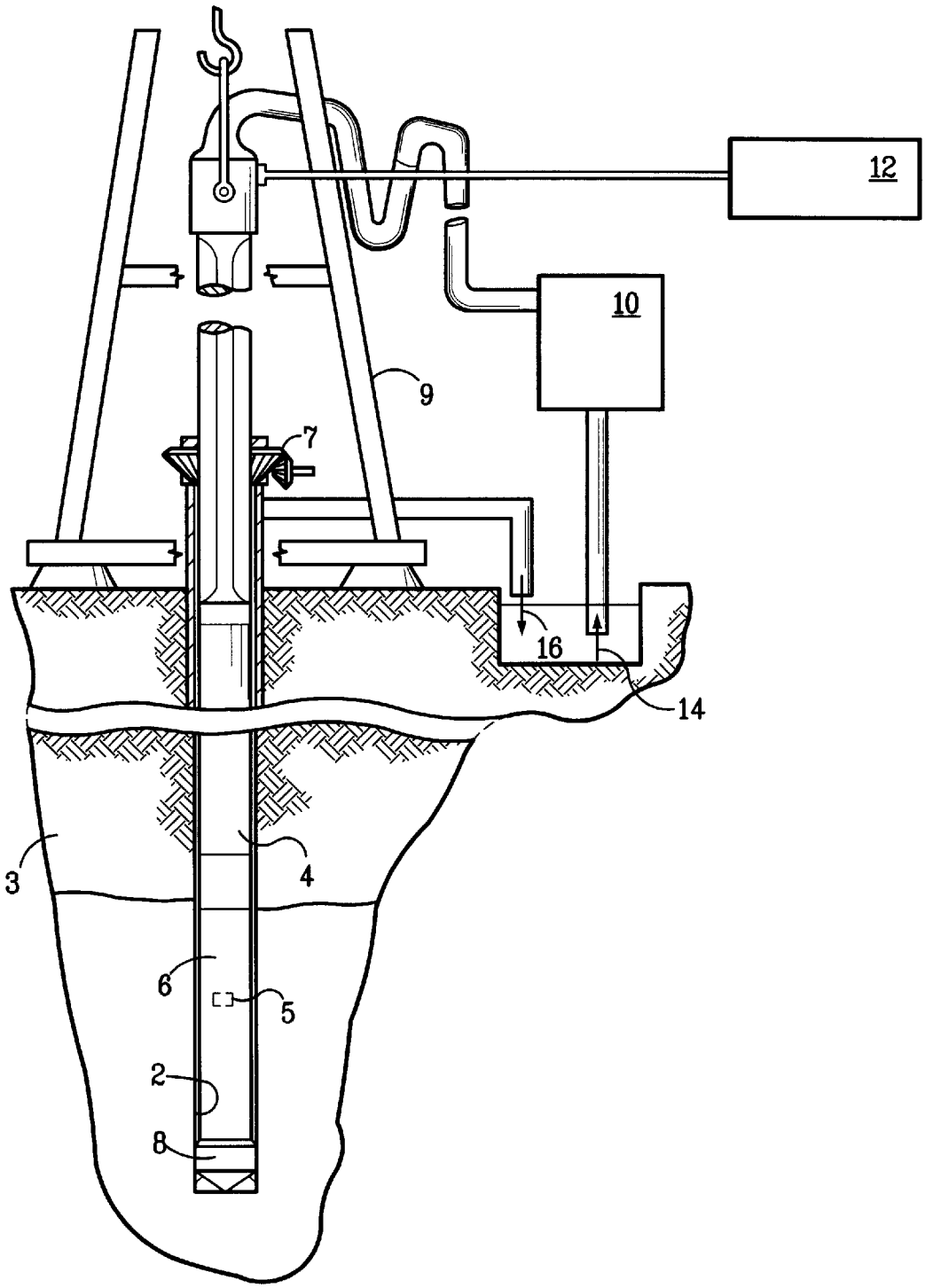
FIG. 1 is a view, partially schematic, of a drilling rig in which the drill string incorporates an apparatus for measuring weight and torque on the drill bit according to the present invention.

A drilling system according to the current invention is shown in FIG. 1. The system comprises a derrick 9 that supports a drill string 4. A drill bit 8 is coupled to the distal end of a drill collar section 6 of the drill string 4. (It should be understood that the term "drill bit" is used broadly herein to encompass coring bits and reamers as well as conventional drill bits.) The drill bit 8 forms a bore 2 in the earthen formation 3. The weight on the drill bit 8 is controlled by varying the hook load on the derrick 9. A prime mover (not shown) drives gearing 7 that rotates the drill string 4 so as to control the torque on the drill bit 8.

As is conventional, a pump 10 pumps drilling mud 14 downward through an internal passage 18, shown in FIG. 2, in the drill string 4. After exiting at the drill bit 8, the returning drilling mud 16 flows upward to the surface through an annular passage formed between the drill string 4 and the bore 2. As is also conventional, a data acquisition system 12 at the surface senses pressure pulsations in the drilling mud 14 created by a mud pulser 5 that contain encoded information concerning the drilling operation.

The drill collar 6 is shown in detail in FIGS. 2 and 3. As is conventional, the drill collar 6 is formed from a section of drill pipe having threaded connections at each end (not shown) that allow it to be coupled into the drill string so that, for example, one end of the drill collar is coupled to the drill bit 8 while the other end is coupled to the uphole section of the drill string. According to the current invention, three pockets 37 (identified as P1, P2 and P2) are circumferentially spaced equidistantly around the circumference of the drill collar 6. Preferably, the pockets 37 are located on a common plane oriented perpendicularly to the centerline E of the drill collar 6. Each pocket 37 extends radially inward from the surface of the drill collar 6 toward the centerline E so as to form a cylindrical side wall 38 and a bottom wall 35. Each pocket 37 is closed by a cap 36, which is secured to the drill collar 6 via a snap ring (not shown) and incorporates O-rings (not shown) that seal the pocket from the drilling mud 16.

As shown in FIG. 3, a first transversely extending passage 24 connects pockets P1 and P2, and a second transversely extending passage 22 connects pockets P2 and P3. As shown in FIG. 2, an axially extending passage 34 connects pocket P2 to a recess 26 formed in the drill collar 6. A circuit board 30 and microprocessor 32 are housed within the recess 26, which is sealed with a cap 28. The passages 22, 24 and 34 permit electrical conductors to extend between the pockets P1, P2 and P2 and between the pocket P2 and the recess 26 so as to complete the circuitry described in detail below.

Figure 4:
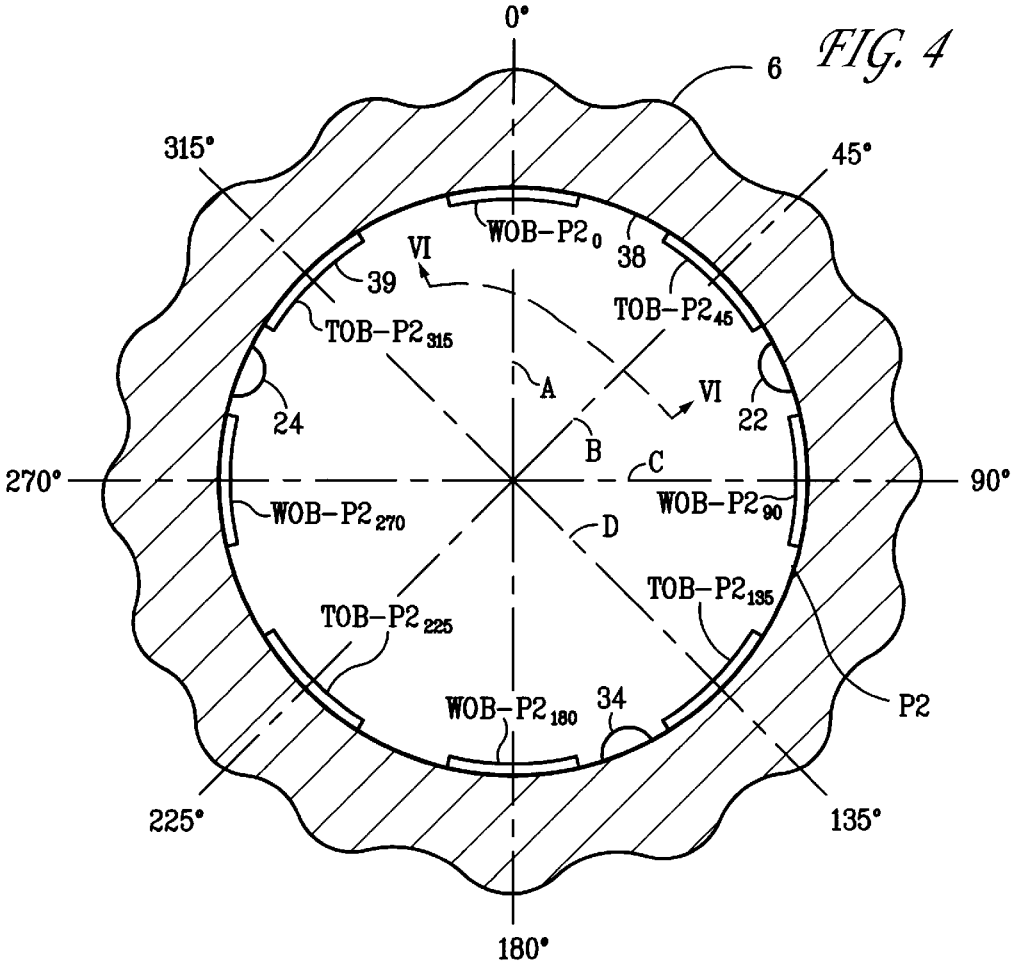
FIG. 4 is an elevation view taken along line IV—IV in FIG. 2 looking into the pocket, with the plug removed, showing the orientation of the strain gages.
Figure 5:
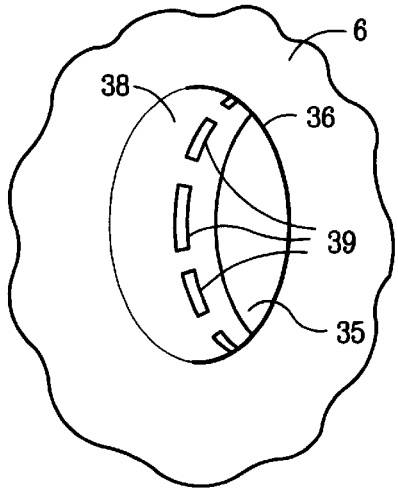
FIG. 5 is an isometric view of the pocket shown in FIG. 4.
Figure 6:
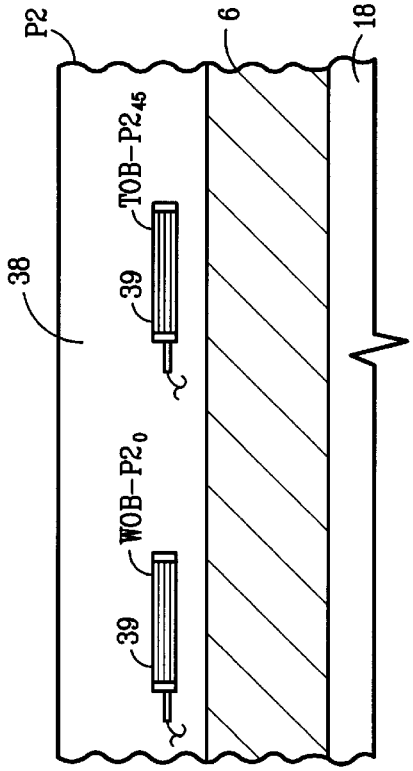
FIG. 6 is a view taken along line VI—VI in FIG. 4 showing a portion of the pocket side wall to which the strain gages are affixed.

As shown in FIGS. 4 through 7, conventional strain gages 39, such as foil or semiconductor type gages, are affixed to the side wall 38 of each of the pockets 36. The details of the arrangement of the stain gages 39 are shown in FIG. 4 for pocket P2 but it should be understood that the strain gages are arranged identically in each of the pockets. As shown in FIG. 6, each stain gage 39 is oriented so that its sensitive axis is oriented in the circumferential direction with respect to the cylindrical side wall 38.

As shown in FIG. 4, eight strain gages 39 are equidistantly spaced around the circumference of the pocket side wall 38. Although each of the stain gages 39 are identical and are similarly oriented with respect to their sensitive axes, the strain gages in each pocket P are electrically connected so as to form two sets of strain gages, each set comprised of four gages.

The first set of strain gages 39 in pocket P2 are identified as $\text{WOB-P2}_0$, $\text{WOB-P2}_{90}$, $\text{WOB-P2}_{180}$, and $\text{WOB-P2}_{270}$ and, together with similarly oriented stain gages in the other two pockets, are used to determine the weight on the drill bit 8. Strain gages WOB-P2$_0$ and WOB-P2$_{180}$ are disposed on opposite sides of the pocket side wall 38 and are located along a line A that is parallel with the center line E of the drill collar 6 so that WOB-P2$_0$ is located at the 0° circumferential orientation and WOB-P2$_{180}$ is located at the 180° orientation, with 0° being top dead center of the pocket P2. Strain gages WOB-P2$_{90}$ and WOB-P2$_{270}$ are also disposed on opposite sides of the pocket side wall 38 and located along a line C that is perpendicular to line A, and therefore to the center line E of the drill collar 6, so that WOB-P2$_{90}$ is located at the 90° circumferential orientation and WOB-P2$_{270}$ is located at the 270° orientation.

The second set of strain gages 39 in pocket P2 are identified as TOB-P2$_{45}$, TOB-P2$_{135}$, TOB-P2$_{225}$, and TOB-P2$_{315}$ and, together with similarly oriented stain gages in the other two pockets, are used to determine the torque on the drill bit 8. Strain gages TOB-P2$_{45}$ and TOB-P2$_{225}$ are disposed on opposite sides of the pocket side wall 38 and located along a line B that is oriented 45° to the center line E of the drill collar 6 so that TOB-P2$_{45}$ is located at the 45° circumferential orientation and TOB-P2$_{225}$ is located at the 225° orientation. Strain gages TOB-P2$_{135}$ and TOB-P2$_{315}$ are also disposed on opposite sides of the pocket side wall 38 and are located along a line D that is perpendicular to line B, and therefore is also oriented at 45° to the center line E of the drill collar 6, so that TOB-P2$_{135}$ is located at the 135° circumferential orientation and TOB-P2$_{315}$ is located at the 315° orientation.

As previously discussed, the strain gages in pockets P1 and P[2]3 are arranged identically to those in pocket P2. Thus, the first set of strain gages 39 in pocket P1 are identified as WOB-P1$_0$, WOB-P1$_{90}$, WOB-P1$_{180}$, and WOB-P1$_{270}$ and, together with similarly oriented stain gages in the other two pockets, are used to determine the weight on the drill bit 8. Strain gages WOB-P1$_0$ and WOB-P1$_{180}$ are disposed on opposite sides of the pocket side wall 38 and are located along a line A that is parallel with the center line of the drill collar 6 so that WOB-P1$_0$ is located at the 0° circumferential orientation and WOB-P1$_{180}$ is located at the 180° orientation, with 0° being top dead center of the pocket P1. Strain gages WOB-P1$_{90}$ and WOB-P1$_{270}$ are also disposed on opposite sides of the pocket side wall 38 and located along a line C that is perpendicular to line A, and therefore to the center line E of the drill collar 6, so that WOB-P1$_{90}$ is located at the 90° circumferential orientation and WOB-P1$_{270}$ is located at the 270° orientation. The second set of strain gages 39 in pocket P1 are identified as TOB-P1$_{45}$, TOB-P1$_{135}$, TOB-P1$_{225}$, and TOB-P1$_{315}$ and, together with similarly oriented stain gages in the other two pockets, are used to determine the torque on the drill bit 8. Strain gages TOB-P1$_{45}$ and TOB-P1$_{225}$ are disposed on opposite sides of the pocket side wall 38 and located along a line B that is oriented 45° to the center line E of the drill collar 6 so that TOB-P1$_{45}$ is located at the 45° circumferential orientation and TOB-P1$_{225}$ is located at the 225° orientation. Strain gages TOB-P1$_{135}$ and TOB-P1$_{315}$ are also disposed on opposite sides of the pocket side wall 38 and are located along a line D that is perpendicular to line B, and therefore is also oriented at 45° to the center line E of the drill collar 6, so that TOB-P1$_{135}$ is located at the 135° circumferential orientation and TOB-P1$_{315}$ is located at the 315° orientation. Similarly, the first set of strain gages 39 in pocket P3 are identified as WOB-P3$_0$, WOB-P3$_{90}$, WOB-P3$_{180}$, and WOB-P3$_{270}$ and, together with similarly oriented stain gages in the other two pockets, are used to determine the weight on the drill bit 8. Strain gages WOB-P3$_0$ and WOB-P3$_{180}$ are disposed on opposite sides of the pocket side wall 38 and are located along a line A that is parallel with the center line of the drill collar 6 so that WOB-P3$_0$ is located at the 0° circumferential orientation and WOB-P3$_{180}$ is located at the 180° orientation, with 0° being top dead center of the pocket P3. Strain gages WOB-P3$_{90}$ and WOB-P3$_{270}$ are also disposed on opposite sides of the pocket side wall 38 and located along a line C that is perpendicular to line A, and therefore to the center line E of the drill collar 6, so that WOB-P3$_{90}$ is located at the 90° circumferential orientation and WOB-P3$_{270}$ is located at the 270° orientation. The second set of strain gages 39 in pocket P3 are identified as TOB-P3$_{45}$, TOB-P3$_{135}$, TOB-P3$_{225}$, and TOB-P3$_{315}$ and, together with similarly oriented stain gages in the other two pockets, are used to determine the torque on the drill bit 8. Strain gages TOB-P3$_{45}$ and TOB-P3$_{225}$ are disposed on opposite sides of the pocket side wall 38 and located along a line B that is oriented 45° to the center line E of the drill collar 6 so that TOB-P3$_{45}$ is located at the 45° circumferential orientation and TOB-P3$_{225}$, is located at the 225° orientation. Strain gages TOB-P3$_{135}$ and TOB-P3$_{315}$ are also disposed on opposite sides of the pocket side wall 38 and are located along a line D that is perpendicular to line B, and therefore is also oriented at 45° to the center line E of the drill collar 6, so that TOB-P3$_{135}$ is located at the 135° circumferential orientation and TOB-P3$_{315}$ is located at the 315° orientation.

Figure 7C:
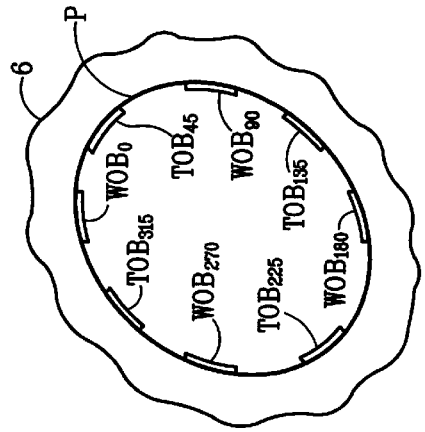
FIGS. 7(*a*), (*b*), and (*c*) show exaggerated views of the distortion of a pocket under compression, tension, and torsion, respectively.
Figure 7B:
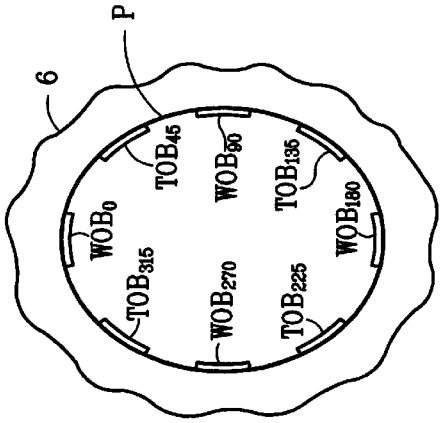
Figure 7A:
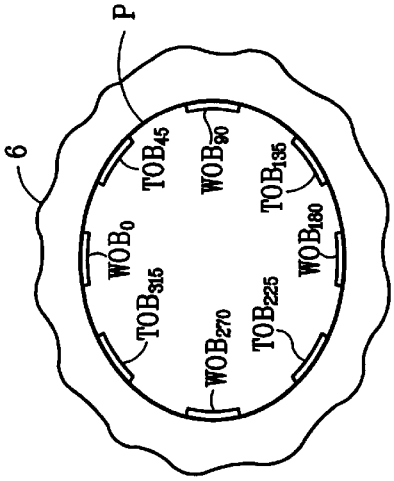

As shown in FIG. 7(*a*), when the portion of the drill collar 6 in the vicinity of a pocket P is subjected to pure axial compression, the stain gages WOB$_0$ and WOB$_{180}$ are placed in tension, while stain gages WOB$_{90}$ and WOB$_{270}$ are placed in compression. The four TOB strain gages, however, are unaffected.

As shown in FIG. 7(*b*), when the portion of the drill collar 6 in the vicinity of a pocket P is subjected to pure axial tension, the stain gages WOB$_0$ and WOB$_{180}$ are placed in compression, while stain gages WOB$_{90}$ and WOB$_{270}$ are placed in tension. The four TOB strain gages remain unaffected.

As shown in FIG. 7(*c*), when the portion of the drill collar 6 in the vicinity of a pocket P is subjected to pure torsion, the stain gages TOB$_{45}$ and TOB$_{225}$ are placed in compression, while stain gages TOB$_{135}$ and TOB$_{315}$ are placed in tension. The four WOB strain gages, however, are unaffected.

Figure 9:
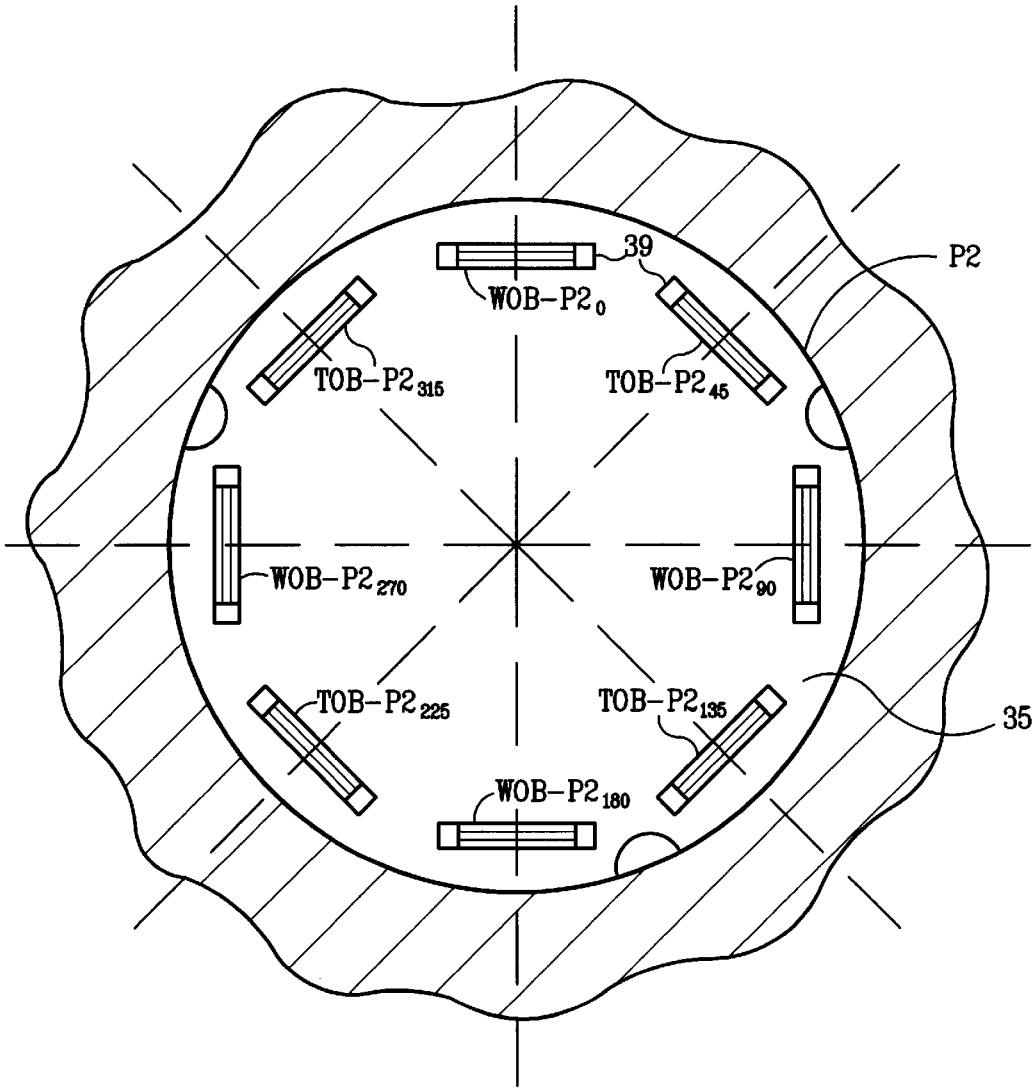
FIG. 9 is a view similar to FIG. 4 showing an alternate embodiment of the invention.

FIG. 9 shows an alternate embodiment in which the stain gages 39 are circumferentially spaced around the bottom wall 35 of each pocket P. Alternatively, the WOB gages could be arranged on the side wall 38 but the TOB gages arranged on the bottom wall 35, or the TOB gages could be arranged on the side wall but the WOB gages arranged on the bottom wall.

Figure 8:
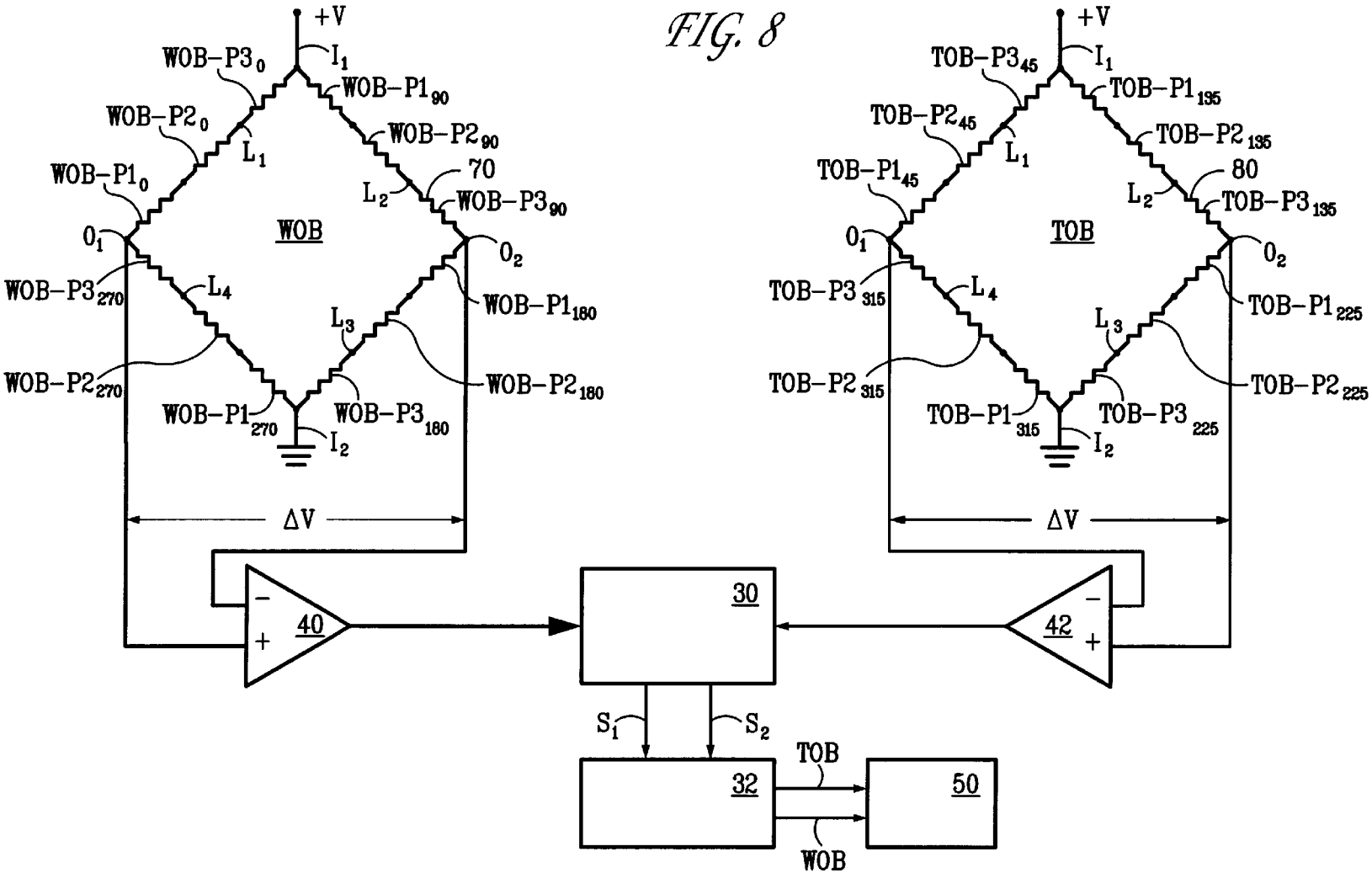
FIG. 8 is schematic diagram of the system for measuring the weight and torque on the drill bit according to the current invention.

As shown in FIG. 8, the four WOB strain gages in the first set of strain gages from each of the three pockets are formed into a first Wheatstone bridge 70 comprised of twelve WOB strain gages arranged in four legs $L_1$, $L_2$, $L_3$, and $L_4$, with leg $L_1$ being opposite to leg $L_3$ and leg $L_2$ being opposite to leg $L_4$. As shown, the WOB strain gages at the 0° orientation in each of the three pockets are connected in series along leg $L_1$, the WOB strain gages at the 90° orientation in each of the three pockets are connected in series along leg $L_2$, the WOB strain gages at the 180° orientation in each of the three pockets are connected in series along leg $L_3$, and the WOB strain gages at the 270° orientation in each of the three pockets are connected in series along leg $L_4$. The junction formed by legs $L_1$ and $L_2$ forms a first input terminal $I_1$, while the junction formed by legs $L_3$ and $L_4$ forms a second input terminal $I_2$. The junction formed by legs $L_2$ and $L_3$ forms a first output terminal $O_1$, while the junction formed by legs $L_4$ and $L_1$ forms a second output terminal $O_2$.

As also shown in FIG. 8, the four TOB strain gages in the second set of strain gages from each of the three pockets are formed into a second Wheatstone bridge 80 comprised of twelve TOB strain gages arranged in four legs $L_1$, $L_2$, $L_3$, and $L_4$, with leg $L_1$ being opposite to leg $L_3$ and leg $L_2$ being opposite to leg $L_4$. As shown, the TOB strain gages at the 45° orientation in each of the three pockets are connected in series along leg $L_1$, the TOB strain gages at the 135° orientation in each of the three pockets are connected in series along leg $L_2$, the TOB strain gages at the 225° orientation in each of the three pockets are connected in series along leg $L_3$, and the TOB strain gages at the 315° orientation in each of the three pockets are connected in series along leg $L_4$. The junction formed by legs $L_1$ and $L_2$ forms a first input terminal $I_1$, while the junction formed by legs $L_3$ and $L_4$ forms a second input terminal $I_2$. The junction formed by legs $L_2$ and $L_3$ forms a first output terminal $O_1$, while the junction formed by legs $L_4$ and $L_1$ forms a second output terminal $O_2$.

Although in the preferred embodiment, four TOB strain gages are used, the invention could also be practiced used only two TOB strain gages provided that they oppose each other—that is, TOB-$\mathbf{P2}_{45}$ and TOB-$\mathbf{P2}_{225}$ or TOB-$\mathbf{P2}_{135}$ and TOB-$\mathbf{P2}_{315}$. In this case, precision resistors would be used in the other two legs of the TOB bridge to balance the bridge.

As is conventional, in operation, voltages V are applied across the pair of input terminals $I_1$ and $I_2$ of each of the bridges 70 and 80. The resistance of the strain gages in each bridge is such that when the strain gages are unstrained, the bridge is balanced and the voltage ΔV across the pair of output terminals $O_1$ and $O_2$ is zero. However, the resistance of the strain gages varies proportionately with the strain so that distortion of the portion of the drill collar forming the pocket wall to which the gages are affixed will result in a voltage drop ΔV across the output terminals.

Importantly, as a result of the arrangement of the strain gages according to the current invention, variations in the bending load on the drill collar 6 resulting from side forces applied to the drill bit 8 will have no effect on the output voltages ΔV of either the WOB or TOB bridges. This is so because the net effect of strain induced by bending is canceled out within each of the legs of the bridges. For example, a bending moment tending to bend the top of the drill collar 6 toward the left as shown in FIG. 2 would place pocket P2 in axial compression, as indicated in FIG. 7(*a*), so that, for example, gage WOB-$\mathbf{P2}_0$ is placed in tension, thereby increasing its resistance. However, pockets P2 and P3 would be placed in axial tension, as indicated in FIG. 7(*b*), so that gages WOB-$\mathbf{P1}_0$ and WOB-$\mathbf{P3}_0$ are each placed in compression, thereby decreasing their resistance. Since the gages WOB-$\mathbf{P1}_0$, WOB-$\mathbf{P2}_0$, and WOB-$\mathbf{P3}_0$ are connected in series in leg $L_1$ of the WOB bridge, there is no net change in the resistance of this leg. A similar canceling out occurs in the other three legs of the WOB bridge so that the bending strain on the drill collar results in no change in the voltage across the output terminals of the WOB bridge. Since the TOB gages are located along lines that are oriented at 45° to the centerline of the drill collar 6, the TOB bridge is also unaffected by bending strain.

The strain indicated by the WOB and TOB bridges 70 and 80 can be determined from the voltage ΔV across their output terminals by the equations:

$$\epsilon_{WOB}=(\Delta V/V)\cdot(2/(1+\mu))\cdot(1/K_g)$$

$$\epsilon_{TOB}=(\Delta V/V))\cdot(1/K_g)$$

where:

$\epsilon_{WOB}$=the strain indicated by the WOB bridge 70

$\epsilon_{TOB}$=the strain indicated by the TOB bridge 80

V=the voltage applied across the input terminals of the bridge

ΔV=the voltage drop across the output terminals of the bridge $K_g$=the gage factor for the strain gage (from the gage manufacturer)

The weight and torque on the drill bit are determined from these strains by the equations:

$$WOB=[\epsilon_{WOB}\cdot E\cdot A]/k_1$$

$$TOB=[\epsilon_{TOB}\cdot J\cdot G]/[R\cdot k_1]$$

where:

WOB=the weight on the drill bit

TOB=the torque on the drill bit

E=the modulus of elasticity for the drill collar material

G=the shear modulus for the drill collar material

A=the cross-sectional area of the drill collar

J=the torsional modulus for the drill collar

R=the radius of the drill collar $k_1$=the stress concentration factor for the pocket As shown in FIG. 8, the voltage drops ΔV from the WOB and TOB bridges 70 and 80 are amplified by amplifiers 40 and 42, respectively, and then sensed by conventional voltage measuring devices incorporated into the circuit board 30. The output signals $S_1$ and $S_2$ from the voltage measuring devices, which are representative of the strain sensed by the WOB and TOB gages, respectively, are sent to a microprocessor 32, where they are digitized. Using these digitized values, the microprocessor 32 is programmed to perform the computations discussed above so as to arrive at the weight and torque on the drill bit. This information is sent to a mud pulse telemetry system 50 for transmission to the surface using the mud pulser 5, where it is detected by the data acquisition system 12.

Preferably, annulus and bore pressure transducers as well as a temperature sensor are incorporated into the drill collar 6 to permit temperature and pressure compensation. Using techniques well known in the art, the microprocessor uses the pressure measurement to calculate the strain due to pressure and then subtract or add this from the apparent strain to get the true WOB and TOB strains. Similarly, based on a curve supplied by the gauge manufacture, which is also programmed into the microprocessor, temperature correction is also performed for the strain gauges.

Although in the embodiment discussed above, three pockets P are utilized, any greater number of pockets could also be utilized provided that the pockets are circumferentially spaced equidistantly and the strain gages in each of the pockets are oriented as discussed above and provided that each of the gages oriented in the same location in each pocket (e.g., each of the 0° gages) are connected into the same leg of the bridge. Moreover, although in the embodiment discussed above, all of the gages within each pocket are located in a common plane oriented perpendicularly to the axis of the pocket, the gages could be located along different planes oriented perpendicularly to the axis of the pocket but displaced from each other along that axis, provided that each pair of opposing gages (e.g., the 0° and 180° pair of gages) are located in approximately the same plane.

Moreover, although in the embodiment discussed above both the WOB and TOB are located in the same pocket, the WOB gages could be located in one set of at least three equidistantly spaced pockets and the TOB gages located in another, independent set of at least three equidistantly spaced pockets. Although in the embodiment discussed above, the pockets are formed into the section of drill pipe forming the drill collar, other sections of the drill string could also be utilized.

Accordingly, it should be realized that the present invention may be embodied in other specific forms without departing from the spirit or essential attributes thereof and that reference should be made to the appended claims, rather than to the foregoing specification, as indicating the scope of the invention.

What is claimed:

1. An apparatus for sensing a force applied to a drill bit operating down hole in a well, comprising:

a) a drill bit;

b) a drill string operatively coupled to said drill bit, said drill string having a section disposed proximate said drill bit;

c) at least first, second and third pockets formed in said section of said drill string, said pockets circumferentially spaced approximately equidistantly around said section of said drill bit, each of said pockets forming at least one wall;

d) a set of strain sensors for each of said pockets, each of said sets of strain sensors affixed to said wall of its respective pocket, each of said sets of strain sensors comprising first, second, third and fourth strain sensors circumferentially spaced approximately equidistantly around said wall of its respective pocket, each of said first strain sensors in each of said sets of strain sensors disposed opposite said third strain sensor in its respective set, each of said second strain sensors in each of said sets of strain sensors disposed opposite said fourth strain sensor in its respective set;

e) circuitry connecting each of said strain sensors in said sets of strain sensors, said circuitry forming a bridge, said bridge comprising (i) first, second, third and fourth legs, (ii) a first junction formed between said first and second legs, (iii) a second junction formed between said third and fourth legs, whereby said first and second junctions form a first pair of terminals, (iv) a third junction formed between said first and fourth legs, (v) a fourth junction formed between said second and third legs, whereby said third and fourth junctions form a second pair of terminals, (vi) each of said first strain sensors in each of said sets of strain sensors connected in series along said first leg of said bridge, (vii) each of said second strain sensors in each of said sets of strain sensors connected in series along said second leg of said bridge, (viii) each of said third strain sensors in each of said sets of strain sensors connected in series along said third leg of said bridge, and (ix) each of said fourth strain sensors in each of said sets of strain sensors connected in series along said fourth leg of said bridge;

f) means for applying a voltage across one of said pairs of terminals;

g) means for sensing a voltage across the other of said pair of terminals;

h) means for determining at least one component of said force on said drill bit from said sensed voltage.

2. The apparatus according to claim 1, wherein said section of said drill string defines a centerline thereof, and wherein said first and third strain sensors in each of said sets of strain sensors are disposed along a line approximately parallel to said centerline of said section of said drill string, and wherein each of said second and fourth strain sensors in each of said sets of strain sensors are disposed along a line approximately perpendicular to said centerline of said section of said drill string, whereby said component of said force on said drill bit determined by said force determining means is the weight on said drill bit.

3. The apparatus according to claim 1, further comprising:

i) a second set of strain sensors for each of said pockets, each of said second sets of strain sensors affixed to said wall of each of its respective pocket, each of said second sets of strain sensors comprising fifth, sixth, seventh, and eight strain sensors circumferentially spaced approximately equidistantly around said wall of its respective pocket, each of said fifth strain sensors in each of said second sets of strain sensors disposed opposite said seventh strain sensors in its respective set, each of said sixth strain sensors in each of said sets of strain sensors disposed opposite said eighth strain sensor in its respective set;

j) circuitry connecting each of said strain sensors in said second sets of strain sensors, said circuitry forming a second bridge, said second bridge comprising first, second, third and fourth legs, (i) a first junction formed between said first and second legs, (ii) a second junction formed between said third and fourth legs, whereby said first and second junctions form a first pair of terminals, (iii) a third junction formed between said first and fourth legs, (iv) a fourth junction formed between said second and third legs, whereby said third and fourth junctions form a second pair of terminals, (v) each of said fifth strain sensors in each of said second sets of strain sensors connected in series along said first leg of said second bridge, (vi) each of said sixth strain sensors in each of said sets of strain sensors connected in series along said second leg of said second bridge, (vii) each of said seventh strain sensors in each of said sets of strain sensors connected in series along said third leg of said second bridge, and (viii) each of said eighth strain sensors in each of said sets of strain sensors connected in series along said fourth leg of said second bridge;

k) means for applying a voltage across one of said pairs of terminals of said second bridge;

l) means for sensing a voltage across the other of said pairs of terminals of said second bridge;

m) means for determining at least a second component of said force on said drill bit from said voltage sensed across second bridge.

4. The apparatus according to claim 3, wherein said section of said drill string defines a centerline thereof, and wherein each of first and third strain sensors in each of said second sets of strain sensors are disposed along a first line oriented approximately 45° to said centerline of said section of said drill string, and wherein each of said second and fourth strain sensors in each of said second sets of strain sensors are disposed along a second line oriented approximately perpendicular to said first line, wherein said second component of said force on said drill bit determined by said force determining means is the torque on said drill bit.

5. The apparatus according to claim 1, wherein said wall is a side wall of said pocket.

6. The apparatus according to claim 1, wherein said wall is a bottom wall of said pocket.

7. The apparatus according to claim 1, wherein said section of said drill string is a drill collar.

8. An apparatus for sensing the weight and torque applied to a drill bit operating down hole in a well, comprising:

a) a drill bit;

b) a drill string operatively coupled to said drill bit, said drill string having a section disposed proximate said drill bit, said section of said drill string defining a centerline thereof;

c) at least first, second and third pockets formed in said section of said drill string, said pockets circumferentially spaced approximately equidistantly around said section of said drill bit, each of said pockets forming at least first and second walls;

d) a first set of strain sensors for each of said pockets, each of said first sets of strain sensors affixed to one of said walls of its respective pocket, each of said first sets of strain sensors comprising first, second, third and fourth strain sensors circumferentially spaced approximately equidistantly around said one of said walls of its respective pocket, each of said first strain sensors in each of said first sets of strain sensors disposed opposite said third strain sensor in its respective set, each of said second strain sensors in each of said first sets of strain sensors disposed opposite said fourth strain sensor in its respective set, each of first and third strain sensors in each of said first sets of strain sensors disposed along a first line approximately parallel to said centerline of said section of said drill string, each of said second and fourth strain sensors in each of said first sets of strain sensors disposed along a second line approximately perpendicular to said centerline of said section of said drill string;

e) first circuitry connecting each of said strain sensors in said first sets of strain sensors, said first circuitry forming a first bridge, said first bridge comprising first, second, third and fourth legs, (i) a first junction formed between said first and second legs, (ii) a second junction formed between said third and fourth legs, whereby said first and second junctions form a first pair of terminals, (iii) a third junction formed between said first and fourth legs, (iv) a fourth junction formed between said second and third legs, whereby said third and fourth junctions form a second pair of terminal, (v) each of said first strain sensors in each of said first sets of strain sensors connected in series along said first leg of said first bridge, (vi) each of said second strain sensors in each of said first sets of strain sensors connected in series along said second leg of said first bridge, (vii) each of said third strain sensors in each of said first sets of strain sensors connected in series along said third leg of said first bridge, and (viii) each of said fourth strain sensors in each of said first sets of strain sensors connected in series along said fourth leg of said first bridge;

f) means for applying a voltage across said one of said first and second pairs of terminals of said first bridge;

g) means for sensing a voltage across the other of said first and second terminals of said first bridge;

h) means for determining said weight on said drill bit from said voltage sensed across said first bridge.

i) a second set of strain sensors for each of said pockets, each of said second sets of strain sensors affixed to one of said walls of its respective pocket, each of said second sets of strain sensors comprising at least fifth and sixth strain sensors spaced around said one of said walls of its respective pocket, each of said fifth strain sensors in each of said second sets of strain sensors disposed opposite said sixth strain sensor in its respective set, each of fifth and sixth strain sensors in each of said second sets of strain sensors disposed along a third line oriented approximately 45° to said first line;

j) second circuitry connecting each of said strain sensors in said second sets of strain sensors, said circuitry forming a second bridge, said second bridge comprising first, second, third and fourth legs, said first leg being opposite said third leg, each of said fifth strain sensors in each of said second sets of strain sensors connected in series along said first leg of said second bridge, each of said sixth strain sensors in each of said sets of strain sensors connected in series along said third leg of said second bridge, said second bridge having a pair of input terminals and a pair of output terminals;

k) means for applying a voltage across said input terminals of said second bridge;

l) means for sensing a voltage across said output terminals of said second bridge;

m) means for determining said torque on said drill bit from said voltage sensed across said output terminals of said second bridge.

9. The apparatus according to claim 8, wherein said first wall of each of said pockets is a side wall, and wherein each of said first sets of strain sensors are affixed to said side wall of its respective pocket.

10. The apparatus according to claim 9, wherein each of said second sets of strain sensors are affixed to said side wall of its respective pocket.

11. The apparatus according to claim 9, wherein said second wall of each of said pockets is a bottom wall, wherein each of said second sets of strain sensors are affixed to said bottom wall of its respective pocket.

12. The apparatus according to claim 8, wherein said first wall of each of said pockets is a bottom wall, wherein each of said first sets of strain sensors are affixed to a bottom wall of its respective pocket.

13. The apparatus according to claim 12, wherein each of said second sets of strain sensors are affixed to said bottom wall of its respective pocket.

14. The apparatus according to claim 12, wherein each of said second sets of strain sensors are affixed to a side wall of its respective pocket.

15. An apparatus for sensing the weight applied to a drill bit coupled to a drill string operating down hole in a well, comprising:

a) a drill pipe, said drill pipe defining a centerline thereof and having means for being coupled into a drill string;

b) at least first, second and third pockets formed in said drill pipe, said pockets circumferentially spaced approximately equidistantly around said drill pipe, each of said pockets forming at least one wall;

c) a set of strain sensors for each of said pockets, each of said sets of strain sensors affixed to said wall of its respective pocket, each of said sets of strain sensors comprising first, second, third and fourth strain sensors circumferentially spaced approximately equidistantly around said wall of its respective pocket, each of said first strain sensors in each of said sets of strain sensors disposed opposite said third strain sensor in its respective set, each of said second strain sensors in each of said sets of strain sensors disposed opposite said fourth strain sensor in its respective set, said first and third strain sensors disposed along a line parallel to said centerline of said drill pipe, said second and fourth strain sensors disposed along a line perpendicular to said centerline of said drill pipe;

e) circuitry connecting each of said strain sensors in said sets, said circuitry forming a bridge, said bridge comprising first, second, third and fourth legs, (i) said first leg of said bridge being opposite to said third leg of said bridge, (ii) said second leg of said bridge being opposite said fourth leg of said bridge, (iii) each of said first strain sensors in each of said sets of strain sensors connected in series along said first leg of said bridge, (iv) each of said second strain sensors in each of said sets of strain sensors connected in series along said second leg of said bridge, (v) each of said third strain sensors in each of said sets of strain sensors connected in series along said third leg of said bridge, and (vi) each of said fourth strain sensors in each of said sets of strain sensors connected in series along said fourth leg of said bridge.

16. The apparatus according to claim 15, wherein (i) a first junction is formed between said first and second legs, (ii) a second junction is formed between said third and fourth legs, whereby said first and second junctions form a first pair of terminals, (iii) a third junction is formed between said first and fourth legs, (iv) a fourth junction is formed between said second and third legs, whereby said third and fourth junctions form a second pair of terminals.

17. The apparatus according to claim 16, further comprising:

f) means for applying a voltage across one of said pairs of terminals;

g) means for sensing a voltage across the other of said pair of terminals;

h) means for determining said weight on said drill bit from said sensed voltage.

18. The apparatus according to claim 15, wherein each of said sets of strain sensors are affixed to a side wall of its respective pocket.

19. The apparatus according to claim 15, wherein each of said sets of strain sensors are affixed to a bottom wall of its respective pocket.

* * * * *

UNITED STATES PATENT AND TRADEMARK OFFICE

CERTIFICATE OF CORRECTION

PATENT NO. : 6,547,016 B2 
DATED : April 15, 2003
INVENTOR(S) : Mark Ellsworth Wassell It is certified that error appears in the above-identified patent and that said Letters Patent is hereby corrected as shown below:

Title page,
Item [54], Title, after "ON" insert -- A --;

Column 4,
Lines 26 and 45, delete "and P2" and insert -- and P3 --;
Lines 59 and 66, "stain" and insert -- strain --;

Column 5,
Line 15, delete "stain" and insert -- strain --;
Line 30, delete "P[2]3" and insert -- P3 --;

Column 6,
Lines 29, 30, 35, 36, 41, 42 and 46, delete "stain" and insert -- strain --;

Column 8,
Line 1, delete "$\varepsilon_{TOB}=(\Delta V/V))\cdot(1/K_g)$" and insert -- $\varepsilon_{TOB}=(\Delta V/V)\cdot(1/K_g)$ --;
Line 15, delete "$WOB=[\varepsilon_{WOB}\cdot E\cdot A]/k_1$" and insert -- $WOB=[\varepsilon_{WOB}\cdot E\cdot A]/k_t$ --;
Line 17, delete "$TOB=[\varepsilon_{TOB}\cdot J\cdot G]/[R\cdot k_1]$" and insert -- $TOB=[\varepsilon_{TOB}\cdot J\cdot G]/[R\cdot k_t]$ --;
Line 28, delete "$k_1$" and insert -- $k_t$ --;

Signed and Sealed this

Fourth Day of November, 2003

JAMES E. ROGAN
*Director of the United States Patent and Trademark Office*